US005424614A

United States Patent [19]

Maheshwari

[11] Patent Number: 5,424,614

[45] Date of Patent: Jun. 13, 1995

[54] MODIFIED HALF-BRIDGE PARALLEL-LOADED SERIES RESONANT CONVERTER TOPOLOGY FOR ELECTRONIC BALLAST

[75] Inventor: Ajay Maheshwari, Dallas, Tex.

[73] Assignee: USI Lighting, Inc., San Leandro, Calif.

[21] Appl. No.: 205,617

[22] Filed: Mar. 3, 1994

[51] Int. Cl.[6] ..... H05B 37/02

[52] U.S. Cl. ..... 315/209 R; 315/219; 315/307; 315/291; 315/DIG. 5; 315/DIG. 7

[58] Field of Search ..... 315/209 R, 219, 291, 315/307, DIG. 5, DIG. 7, 224, 229, 235

[56] References Cited

U.S. PATENT DOCUMENTS 5,130,610 7/1992 Kakitani ..... 315/219
5,331,253 7/1994 Counts ..... 315/209 R
5,332,951 7/1994 Turner et al. ..... 315/209 R
5,341,068 8/1994 Nerone ..... 315/219

*Primary Examiner*—Robert J. Pascal
*Assistant Examiner*—Haissa Philogene
*Attorney, Agent, or Firm*—Thomas E. Schatzel

[57] ABSTRACT

An electronic ballast embodiment of the present invention comprises a half-bridge parallel-loaded series resonant converter (HB-PLSRC) circuit a load is connected across a resonating capacitor with DC blocking capacitors in each of two legs and in series with a resonating inductor. The combination is connected to the junction of two switches wired in series across a DC source input such that the resonant inductor and resonant capacitor are connected across one of the switches. A coordinated manipulation of the switches is then used to charge and discharge the resonant inductor and resonant capacitor are pumped in series resonance. Alternatively, the load is connected through an isolation transformer.

6 Claims, 3 Drawing Sheets

MODIFIED HALF-BRIDGE PARALLEL-LOADED SERIES RESONANT CONVERTER TOPOLOGY FOR ELECTRONIC BALLAST

BACKGROUND OF THE INVENTION

1. Field of the Invention

The present invention relates generally to gas discharge lighting systems, and more specifically to electronic ballasts.

2. Description of the Prior Art

Half-bridge parallel-loaded series resonant converter (HB-PLSRC)circuit topologies are conventional for electronic ballasts. FIG. 1 illustrates a HB-PLSRC 10 where a direct current (DC) source 12 represents a DC bus. HB-PLSRC 10 includes a pair of switches 14 and 16, a resonant inductor 18, a resonant capacitor 20, a load 22 which represents a gas discharge lamp, and a pair of DC blocking capacitors 24 and 26. A DC current is thus prevented from flowing through the load 22. HB-PLSRC 10 is conventionally used in conjunction with an isolation transformer at the output, since there is no protection against a ground fault at the junction of load 22, resonant capacitor 20 and resonant inductor 18.

FIG. 2 illustrates a second HB-PLSRC 30 that includes active ground fault protection and a non-isolated output. A DC power source 32 is connected to the input. HB-PLSRC 30 includes a pair of switches 34 and 36, a resonant inductor 38, a resonant capacitor 40, a load 42 which represents a gas discharge lamp, and a pair of DC blocking capacitors 44 and 46. In HB-PLSRC 30, capacitor 44 limits any ground fault current at the junction of resonant inductor 38, resonant capacitor 40 and load 42.

Both HB-PLSRC 10 and HB-PLSRC 30 experience difficulties in electronic ballast applications where the circuit starts up without a load current. Gas discharge lamps, e.g., loads 22 and 42, do not immediately draw a current because the voltage applied across them must be raised high enough to start ignition. Until then, such lamps present a very high impedance. Thus, during start up or when the load is removed, much higher than normal currents can flow in the resonant components. Surge currents also flow through the DC blocking capacitors, since they are in series with the resonant inductor and capacitor tank circuit. Under typical operating conditions, the DC blocking capacitors are expected to carry currents that exceed those flowing through the load, because the resonating currents must also be supported. Surge currents will stress these components and high quality components with sufficient operating margins must be used to guarantee reliable, long-term operation. The DC blocking capacitors must also be sufficiently larger than their corresponding resonant capacitors so that their capacitive values do not substantially control the resonant frequency of the resonant inductor and resonant capacitor combination.

SUMMARY OF THE PRESENT INVENTION

It is therefore an object of the present invention to provide a half-bridge parallel-loaded series resonant converter (HB-PLSRC) circuit topology for electronic ballasts.

It is a further object of the present invention to provide a reduced-cost electronic ballast.

Briefly, an electronic ballast embodiment of the present invention comprises a half-bridge parallel-loaded series resonant converter (HB-PLSRC) circuit with a load connected across a resonating capacitor and DC blocking capacitors in each of two legs extending between the load and the resonating capacitor with a resonant inductor extending from a junction of one of said blocking capacitors and resonating capacitor. The combination is connected to the junction of two switches wired in series across a DC source input such that the resonant inductor and resonant capacitor are connected across one of the switches. The switches alternately charge and discharge the resonant inductor and resonant capacitor. Alternatively, the load is connected through an isolation transformer.

An advantage of the present invention is that it provides a half-bridge parallel-loaded series resonant converter (HB-PLSRC) circuit topology for electronic ballasts in which relatively smaller DC blocking capacitors with looser tolerances may be used.

Another advantage of the present invention is that it provides a ballast that is economical to manufacture.

A still further advantage of the present invention is that a half-bridge parallel-loaded series resonant converter (HB-PLSRC) circuit topology for electronic ballasts is provided in which the DC blocking capacitors are effectively not a part of the resonant circuit.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENTS

Figure 1:
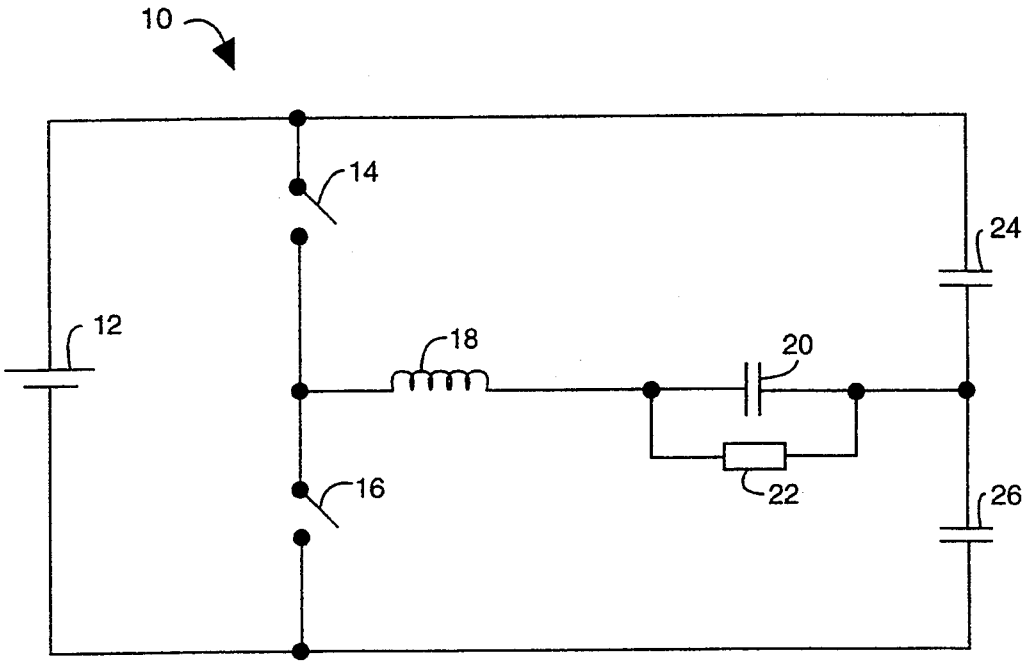
Fig. 1 (prior art)
FIG. 1 is a schematic diagram of a prior art half-bridge parallel-loaded series resonant converter circuit topology for an electronic ballast.
Figure 2:
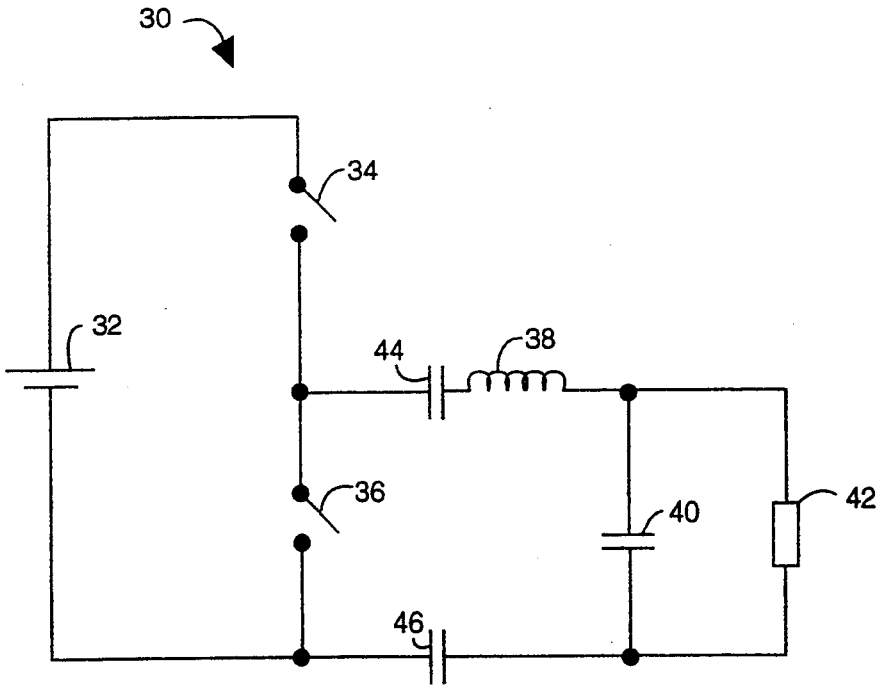
Fig. 2 (prior art)
FIG. 2 is a schematic diagram of another prior art half-bridge parallel-loaded series resonant converter circuit topology for an electronic ballast.
Figure 3:
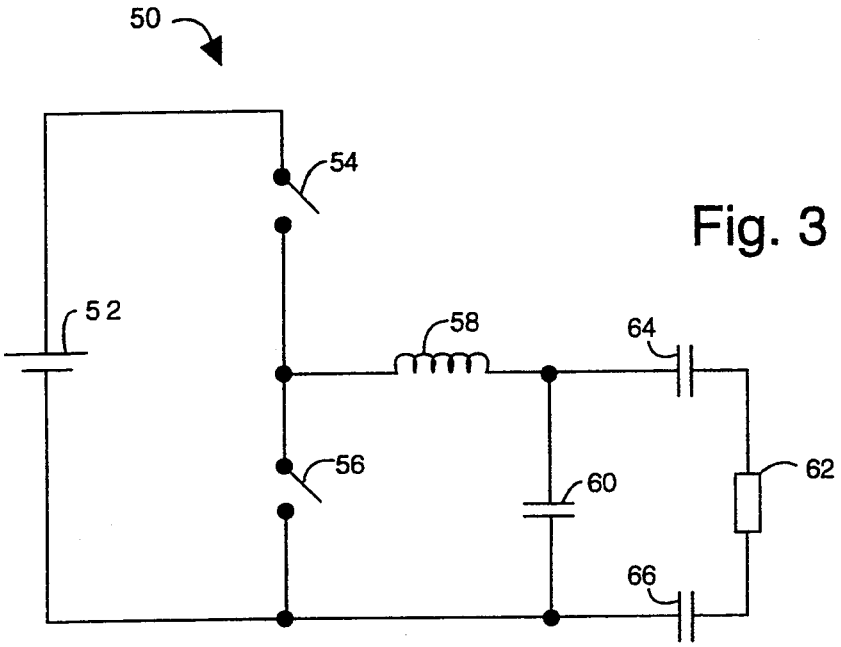
FIG. 3 is a schematic diagram of a half-bridge parallel-loaded series resonant converter circuit topology for an electronic ballast embodiment of the present invention.

FIG. 3 illustrates a half-bridge parallel-loaded series resonant converter (HB-PLSRC) topology for an electronic ballast embodiment of the present invention, referred to by the general reference numeral 50. The HB-PLSRC 50 comprises a direct current (DC) source 52, a pair of switches 54 and 56, a resonant inductor 58, a resonant capacitor 60, a load 62 which represents a gas discharge lamp, and a pair of DC blocking capacitors 64 and 66. A DC current is thus prevented from flowing through the load 62. The DC source 52 may conventionally comprise a full-wave bridge rectifier connected to an AC power line input. Switches 54 and 56 are typically implemented with power metal oxide semiconductor field effect transistors (MOSFETs). The load 62 comprises a gas discharge lamp, such as a fluorescent lamp.

A conventional control circuit may be connected to drive switches 54 and 56. For example, electronic ballasts generally employ an oscillator that sets the fundamental frequency of output switching transistors (switches 54 and 56) that drive an output network. The output network delivers power to the fluorescent tubes (load 62) that depends in magnitude on the frequency of the oscillator, the direct current voltage and the value of resistors, capacitors, and inductors in the ballast and output network. A common method of controlling lamp performance is to measure or sample the output current flowing through the lamps and to feed that sample current back to a current-controlled oscillator. The oscillator may also be a voltage-controlled type, wherein a frequency output directly controls the output current.

Figure 4:
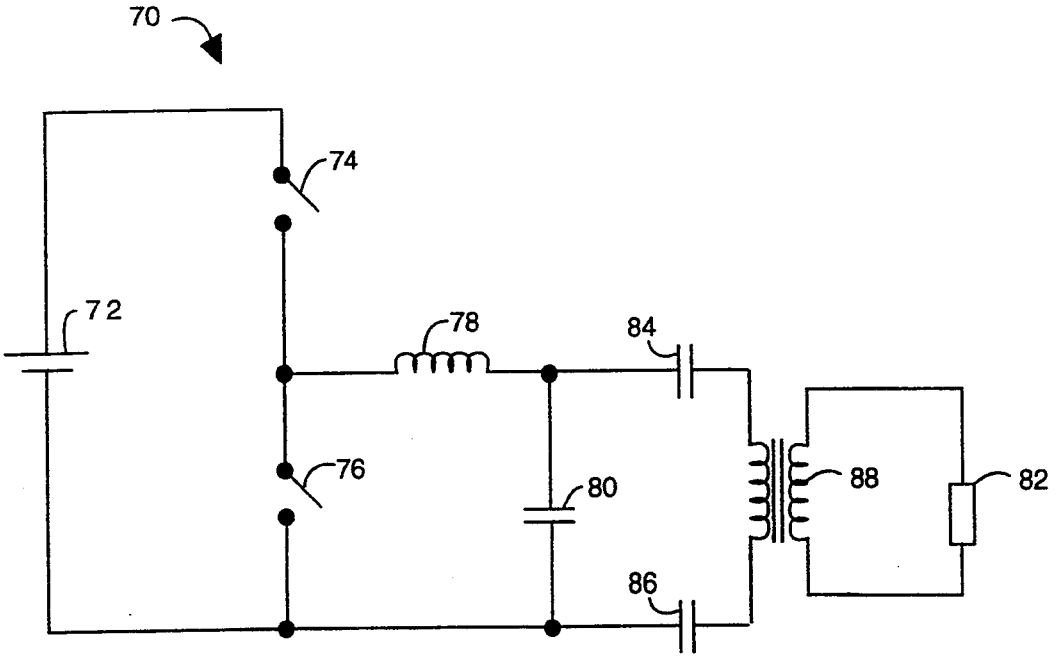
FIG. 4 is a schematic diagram of another half-bridge parallel-loaded series resonant converter circuit topology for an electronic ballast embodiment of the present invention.

FIG. 4 illustrates another half-bridge parallel-loaded series resonant converter (HB-PLSRC) topology for an electronic ballast embodiment of the present invention, referred to by the general reference numeral 70. The HB-PLSRC 70 comprises a direct current (DC) source 72, a pair of switches 74 and 76, a resonant inductor 78, a resonant capacitor 80, a load 82 which represents a gas discharge lamp, a pair of DC blocking capacitors 84 and 86, and an isolation transformer 88. A DC current is thus prevented by blocking capacitors 84 and 86 from flowing through the isolation transformer 88. HB-PLSRC 70 includes an isolation transformer 88 at the output and in front of the load 82.

In HB-PLSRC 50 and 70, the DC blocking capacitors 64, 66, 84 and 86 are not a part of the resonant circuits of inductor 58 and capacitor 60, and inductor 78 and capacitor 80. However, the ground fault current limiting function of the DC blocking capacitors 64, 66, 84 and 86 is retained in HB-PLSRC 50 and 70. Therefore, the DC blocking capacitors 64, 66, 84 and 86 do not carry a high surge current during start up or when loads 62 or 82 are removed. In fact, the start up current through the DC blocking capacitors 64, 66, 84 and 86 is near zero, since they are effectively in series with the load and no current flows in the load until the lamp ignites. The maximum current seen by the DC blocking capacitors 64, 66, 84 and 86 is the load current, which is significantly lower than the current circulating within inductor 58 and capacitor 60, and inductor 78 and capacitor 80.

Figure 5:
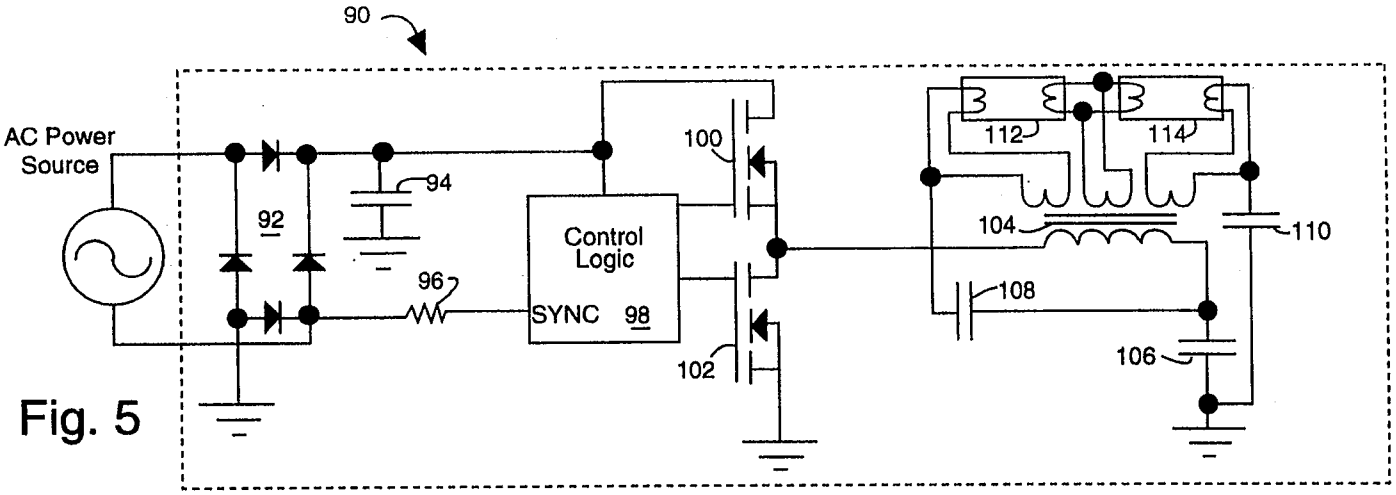
FIG. 5 is a schematic diagram of a complete ballast incorporating the circuit of FIG. 3.

FIG. 5 illustrates a ballast 90 which incorporates a converter circuit similar to that shown in FIG. 3. The ballast 90 comprises a full-wave rectifier 92, a DC filter capacitor 94, a sixty-hertz sampling resistor 96 connected to a frequency control logic 98, a first power MOSFET 100, a second power MOSFET 102, a resonating inductor 104, a resonating capacitor 106, a pair of DC blocking capacitors 108, 110 and a pair of fluorescent lamps 112 and 114. Except for the positioning of resonating inductor 104 and resonating capacitor 106, the ballast 90 is similar to that disclosed in copending U.S. Pat. application Ser. No. 07/934,411, filed Aug. 24, 1992, which application is incorporated here in its entirety by reference.

Figure 6:
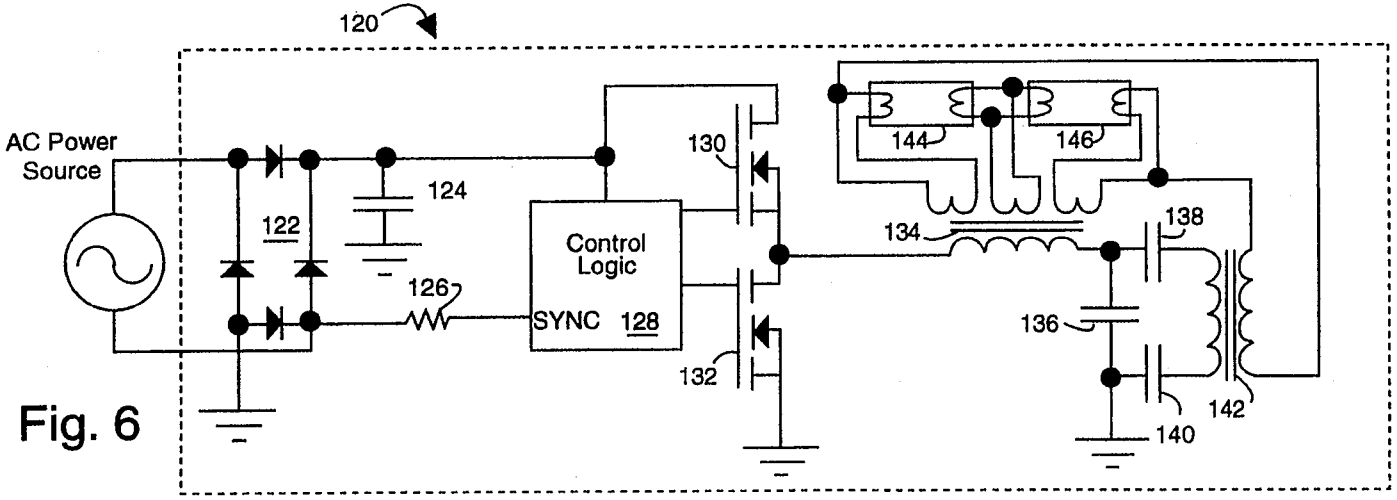
FIG. 6 is a schematic diagram of a complete ballast incorporating the circuit of FIG. 4.

FIG. 6 illustrates another ballast 120 which incorporates a converter circuit similar to that shown in FIG. 4. The ballast 120 comprises a full-wave rectifier 122, a DC filter capacitor 124, a sixty-hertz sampling resistor 126 connected to a frequency control logic 128, a first power MOSFET 130, a second power MOSFET 132, a resonating inductor 134, a resonating capacitor 136, a pair DC blocking capacitors 138 and 140, an output transformer 142 and a pair of fluorescent lamps 144 and 146.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A half-bridge parallel-loaded series resonant converter (HB-PLSRC) (50, 70) for an electronic gas discharge lamp ballast, comprising:

a first and a second power switch (54, 56, 74, 76) connected in series across a direct current (DC) power input;

a resonant inductor (58, 78) and a resonant capacitor (60, 80) connected in series across one of the first and second power switches;

a power output for a gas discharge lamp load (62, 82) having a first and a second load output terminal;

a first DC blocking capacitor (64, 84) connected in series between said first load output terminal and a junction of the resonant inductor and the resonant capacitor; and a second DC blocking capacitor (66, 86) connected in series between said second load output terminal and a junction of the resonant capacitor and one of the first and second power switches.

2. The HB-PLSRC of claim 1, further comprising:

first and second DC blocking capacitors and a secondary winding output for connection across a gas discharge lamp load (82).

3. A half-bridge parallel-loaded series resonant converter (HB-PLSRC) (50) for an electronic gas discharge lamp ballast, comprising:

a direct current (DC) power source (52);

a pair of power switches (54, 56) connected in series across the DC power source;

a resonant inductor (58) connected at one end to a common junction of the pair of power switches;

a load (62) connected through a pair of DC blocking capacitors (64, 66) to a junction of one of the pair of power switches and the DC power supply and connected to an end of the resonant inductor opposite to said end connected to the pair of power switches; and a resonant capacitor (60) connected in parallel to the load and in series with the resonant inductor on the non-load side of both of said DC blocking capacitors.

4. The HB-PLSRC of claim 3, wherein:

the load (62) includes at least one of a fluorescent lamp or a pair of fluorescent lamps connected in series.

5. A ballast (90) for powering fluorescent lamps (112 and 114), comprising:

a rectifier (92) for connection to an alternating current (AC) power source and providing a direct current (DC) output;

a sampling resistor (96) connected to the rectifier (92) providing for a sample signal of said AC power source;

a control logic (98) connected to receive said sample signal and to control a pair of switching transistors (100, 102) connected in series across said DC output of the rectifier (92);

a resonating inductor (104) with a primary winding connected in series with a resonating capacitor (106) across one of said switching transistors (100, 102) and a plurality of secondary windings providing for connections to respective filaments of a fluorescent lamp (112, 114); and a pair of DC blocking capacitors (108) and (110) with one DC blocking capacitor (108) connected between one of said secondary windings of the inductor (104) and a junction of the resonating capacitor (106) and said primary winding, and with the other DC blocking capacitor (110) connected between another one of said secondary windings of the inductor (104) and said DC output of the rectifier (92), providing for an ignition voltage to be developed across said fluorescent lamp (112, 114).

6. A ballast (120) for powering fluorescent lamps (144, 146), comprising:

a rectifier (122) for connection to an alternating current (AC) power source and providing a direct current (DC) output;

a sampling resistor (126) connected to the rectifier (122) providing for a sample signal of said AC power source;

a control logic (128) connected to receive said sample signal and to control a pair of switching transistors (130, 132) connected in series across said DC output of the rectifier (122);

a resonating inductor (134) with a primary winding connected in series with a resonating capacitor (136) across one of said switching transistors (130, 132) and a plurality of secondary windings providing for connections to respective filaments of a fluorescent lamp (144, 146); and a DC blocking capacitor (138, 140) connected in series with a primary winding of an isolation transformer (142) with the series combination connected in parallel across said resonating capacitor (136) and a secondary winding of said isolation transformer (142) connected between two of said secondary windings of the inductor (134), providing for an ignition voltage to be developed across said fluorescent lamp (144, 146).

* * * * *